US009967677B2

(12) United States Patent
Wiesbauer et al.

(10) Patent No.: US 9,967,677 B2
(45) Date of Patent: May 8, 2018

(54) SYSTEM AND METHOD FOR SENSOR-SUPPORTED MICROPHONE

(71) Applicant: Infineon Technologies AG, Neubiberg (DE)

(72) Inventors: Andreas Wiesbauer, Poertschach (AT); Marc Fueldner, Neubiberg (DE); Elmar Bach, Villach (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 149 days.

(21) Appl. No.: 14/959,560

(22) Filed: Dec. 4, 2015

(65) Prior Publication Data

US 2017/0164118 A1 Jun. 8, 2017

(51) Int. Cl.

| | |
|---|---|
| ***H04R 3/00*** | (2006.01) |
| ***H04R 19/04*** | (2006.01) |
| ***H04R 1/04*** | (2006.01) |
| ***H04R 3/04*** | (2006.01) |
| ***H04R 29/00*** | (2006.01) |

(52) U.S. Cl.

CPC ..... *H04R 19/04* (2013.01); *H04R 1/04* (2013.01); *H04R 3/04* (2013.01); *H04R 29/004* (2013.01); *H04R 2201/003* (2013.01); *H04R 2430/01* (2013.01)

(58) Field of Classification Search

CPC . H04R 19/04; H04R 1/04; H04R 3/04; H04R 29/004; H04R 2201/003; H04R 2430/01

USPC ..... 381/113

See application file for complete search history.

(56) References Cited

U.S. PATENT DOCUMENTS

| | | | | |
|---|---|---|---|---|
| 9,247,331 | B2 | 1/2016 | Suvanto | |
| 2010/0008515 | A1* | 1/2010 | Fulton | H04R 3/005 381/92 |
| 2012/0269363 | A1* | 10/2012 | Suvanto | H04R 1/04 381/107 |
| 2013/0218502 | A1* | 8/2013 | Artiuch | G01L 9/045 702/98 |

FOREIGN PATENT DOCUMENTS

| | | | |
|---|---|---|---|
| WO | 2011001195 | A1 | 1/2011 |
| WO | 2015161874 | A1 | 10/2015 |

* cited by examiner

*Primary Examiner* — Vivian Chin
*Assistant Examiner* — Ammar Hamid
(74) *Attorney, Agent, or Firm* — Slater Matsil, LLP

(57) ABSTRACT

A system and method for a sensor-supported microphone includes an amplifier having an input configured to be coupled to a transducer, and an output coupled to an analog interface to output a transduced electrical signal from the transducer, a data bus configured to be coupled to an environmental sensor, a calibration parameter storage circuit coupled to the data bus, the calibration parameter storage circuit comprising calibration data relating sensitivity of the transducer with environmental measurements provided by the environmental sensor, and a digital interface coupled to the data bus and configured to output the calibration data and the environmental measurements.

23 Claims, 7 Drawing Sheets

SYSTEM AND METHOD FOR SENSOR-SUPPORTED MICROPHONE

TECHNICAL FIELD

The present invention relates generally to sensors and transducers, and in particular embodiments, to techniques and mechanisms for a sensor-supported microphone.

BACKGROUND

Transducers convert signals from one domain to another and are often used in sensors. Common examples of sensors include microphones and thermometers. Such devices convert environmental phenomenon (sound, heat, etc.) into electrical signals.

Microelectromechanical system (MEMS) based sensors include a family of transducers produced using micromachining techniques. MEMS devices, such as MEMS microphones, gather information from the environment by measuring changes in the physical state in the transducer and transferring a transduced electrical signal to processing electronics that are connected to the MEMS sensor. Many MEMS devices detect changes in capacitance in the sensor, which can be converted to a voltage signal using interface circuits. MEMS devices may be manufactured using micromachining fabrication techniques similar to those used for integrated circuits. Common MEMS devices include oscillators, resonators, accelerometers, gyroscopes, pressure sensors, microphones, and micro-mirrors.

Performance of MEMS devices may be affected by the environment. Environmental dependency may be reduced by designing certain aspects of MEMS devices and packages, such as thickness of substrates or glue properties.

SUMMARY OF THE INVENTION

Technical advantages are generally achieved by embodiments of this disclosure, which describe systems and methods for a sensor-supported microphone.

In accordance with an embodiment, a device is provided. The device includes an amplifier having an input configured to be coupled to a transducer, and an output coupled to an analog interface to output a transduced electrical signal from the transducer, a data bus configured to be coupled to an environmental sensor, a calibration parameter storage circuit coupled to the data bus, the calibration parameter storage circuit comprising calibration data relating sensitivity of the transducer with environmental measurements provided by the environmental sensor, and a digital interface coupled to the data bus and configured to output the calibration data and the environmental measurements.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

Figure 1:
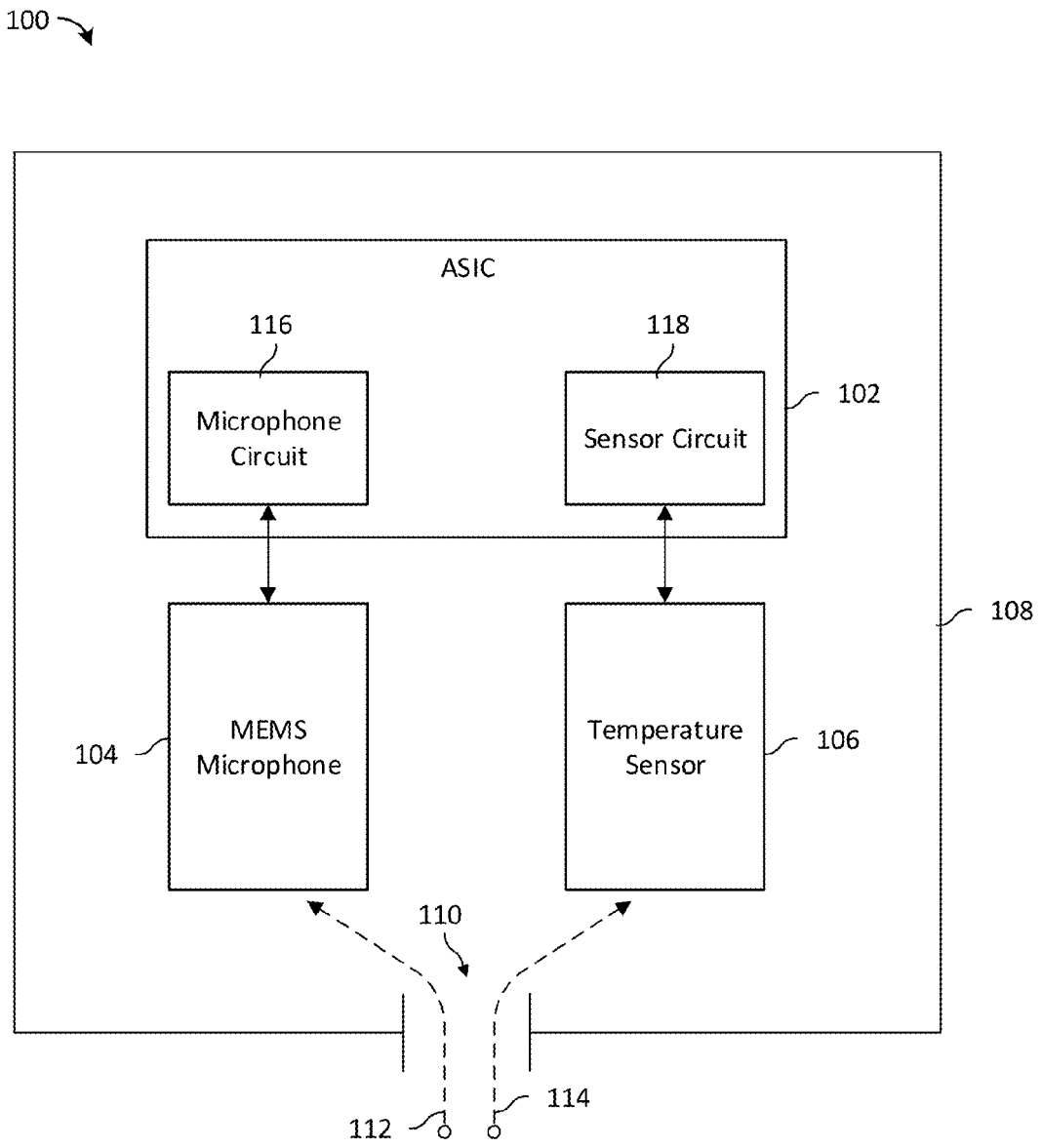
FIG. 1 illustrates a block diagram of an embodiment transducer package.

The making and using of embodiments of this disclosure are discussed in detail below. It should be appreciated, however, that the concepts disclosed herein can be embodied in a wide variety of specific contexts, and that the specific embodiments discussed herein are merely illustrative and do not serve to limit the scope of the claims. Further, it should be understood that various changes, substitutions and alterations can be made herein without departing from the spirit and scope of this disclosure as defined by the appended claims.

Various embodiments integrate an environmental sensor with a transducer package for a MEMS device. Properties of the MEMS device, such as such as sensitivity, offset, distortion, etc., may be calibrated by combining output from the environmental sensor with a function relating the environmental sensor to properties of the MEMS device. The function may be, e.g., a polynomial function, and devices may perform calibration by receiving coefficients for the polynomial function. Drift in the output signal from the transducer package may then be corrected according to the computed change in MEMS device properties. In some embodiments, a system that the transducer package is integrated with may receive the sensor output and polynomial coefficients along with the MEMS device output signal from the transducer package, and perform correction at the system or application level. In some embodiments, the transducer package itself may use the sensor output and polynomial coefficients to correct the MEMS device output signal at the package level, before it is output to the system.

Embodiments may also allow drifting of other components in a transducer package to be corrected. For example, a transducer package may include other devices such as an application specific integrated circuit (ASIC). Performance parameters of those devices may drift with ambient environmental conditions. Inclusion of the environmental sensor may also allow correction of drifts in the performance parameters of these devices. Such performance parameters may include, for example, bias current, bias impedance, current consumption, gain, offset, clock frequency, etc.

Various embodiments may achieve advantages. MEMS devices and packages can suffer from relatively larger sensitivity to environmental conditions such as temperature and stress. This sensitivity to the environment may increase as devices are further reduced in size. Correcting the output electrical signals of MEMS devices may reduce drift from MEMS devices, increasing accuracy and reliability of such devices. Performing correction at the system or application level may allow for relatively simple circuitry for correcting device outputs in the transducer package, while performing correction at the device level may allow for relatively simple programming at the system or application level. Environmental drifts have traditionally imposed design constraints on MEMS packages. Correcting environmental drifts in the output of a MEMS device may allow MEMS packages to be designed free from these constraints.

While the illustrated embodiments are presented in the context of microphone sensitivities and temperature sensors, it should be appreciated that techniques presented herein could be used to correct a wide array of electrical signals from MEMS devices, and this correction could be performed with many types of environmental sensors. For example, electrical signals from accelerometers or gyroscopes could also be corrected, and other environmental sensors such as pressure sensors, humidity sensors, resistive sensors, or mechanical stress sensors could be used. Further, more than one sensor and/or type of sensor could be used.

FIG. 1 illustrates a block diagram of an embodiment transducer package 100. The transducer package 100 includes an ASIC 102, a MEMS microphone 104, a temperature sensor 106, a case 108. The case 108 has a port 110 that allows coupling of the MEMS microphone 104 to the ambient environment through sound coupling 112 and allows coupling of the temperature sensor 106 to the ambient environment through temperature coupling 114. In various embodiments, the positioning and integration of the MEMS microphone 104 and the temperature sensor 106 may vary, as described below.

The ASIC 102 includes a microphone circuit 116 and a sensor circuit 118. The MEMS microphone 104 is coupled to the microphone circuit 116, and the temperature sensor 106 is coupled to the sensor circuit 118. The microphone circuit 116 interfaces the MEMS microphone 104 with the ASIC 102 and other devices. The sensor circuit 118 interfaces the temperature sensor 106 with the ASIC 102 and other devices. In some embodiments, the temperature sensor 106 may be a device integrated with the ASIC 102. While the illustrated embodiments show the MEMS microphone 104 and the temperature sensor 106 coupled to the environment through a shared port and coupled to the ASIC 102, it should be appreciated that the device may have multiple ports and/or may have different interface circuits that are not integrated into a single ASIC die or circuit board.

Figure 2:
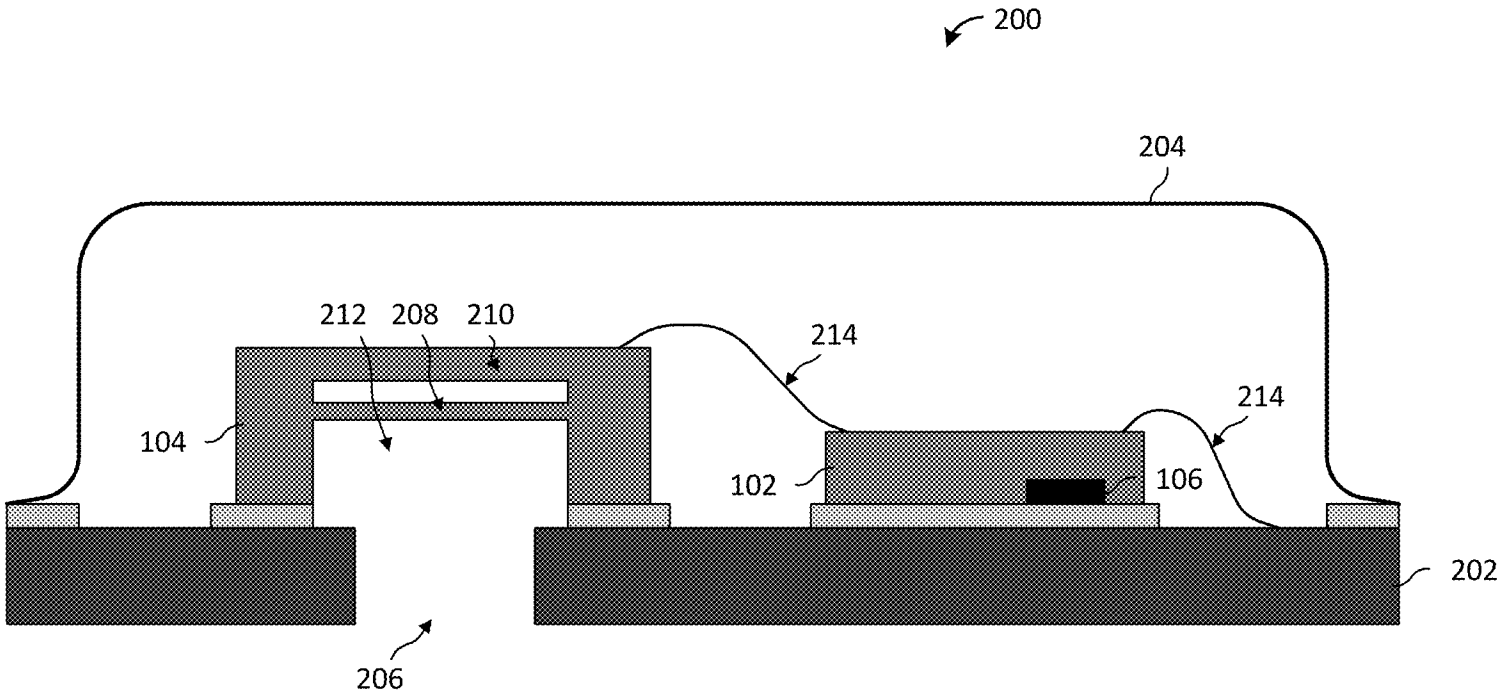
FIG. 2 illustrates schematic cross-sections of an embodiment transducer package.

FIG. 2 illustrates schematic cross-sections of an embodiment transducer package 200. The transducer package 200 includes the ASIC 102, the MEMS microphone 104, the temperature sensor 106, a circuit board 202, a lid 204, and a port structure 206. The port structure 206 may be included in the circuit board 202, such that sound may be transmitted from the ambient environment to the MEMS microphone 104 through the port structure 206. The ASIC 102, the MEMS microphone 104, and the lid 204 may be attached to circuit board 202 using glue or a conductive paste.

The MEMS microphone 104 includes a membrane 208, a backplate 210, and a cavity 212. The membrane 208 separates the space or region enclosed by the circuit board 202 and the lid 204 from the ambient environment available through the port structure 206. In some embodiments, acoustic signals propagate through the port structure 206 into the cavity 212 of the MEMS microphone 104. Such acoustic signals cause the membrane 208 to deflect, which causes the MEMS microphone 104 to generate transduced electrical signals based on the incident acoustic signals.

In the illustrated embodiment, the ASIC 102 and the MEMS microphone 104 are formed on different semiconductor devices and integrated into a single package. In such embodiments, the transducer package 200 includes interconnecting conductive lines 214. The interconnecting conductive lines 214 couple the MEMS microphone 104 with the ASIC 102. The interconnecting conductive lines 214 may also couple the ASIC 102 with conductive lines (not shown) on the circuit board 202, which may be a printed circuit board (PCB). In some embodiments, the ASIC 102 and the MEMS microphone 104 may be formed on the same semiconductor die, and thus the transducer package 200 may not have the interconnecting conductive lines 214.

Figure 3:
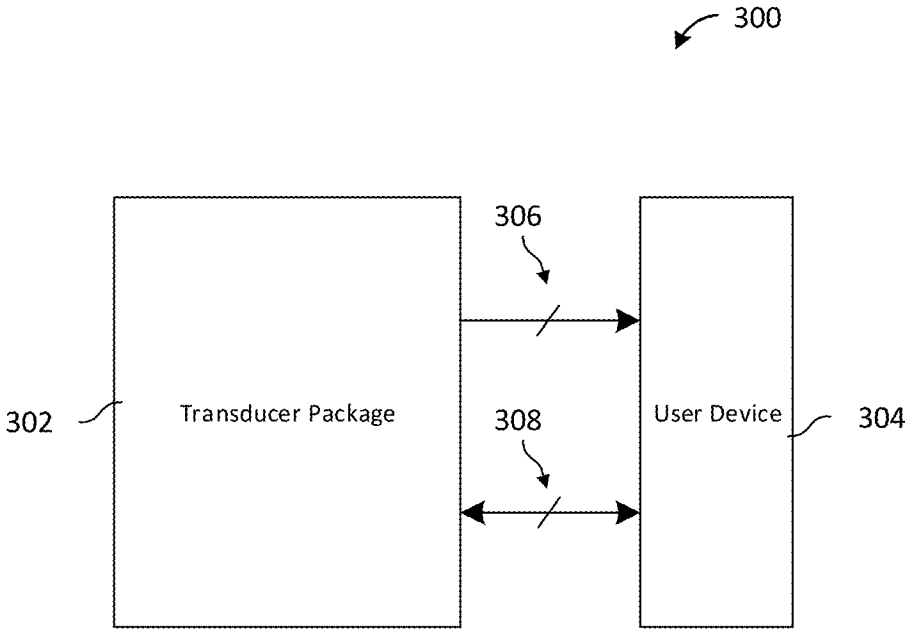
FIG. 3 illustrates an embodiment integrated system.

FIG. 3 illustrates an embodiment integrated system 300. The integrated system 300 includes a transducer package 302, a user device 304, output signals 306, and sensor and control signals 308. The transducer package 302 may be, e.g., a package that includes a MEMS device, an environmental sensor, and corresponding support circuitry for correcting the MEMS device with output from the environmental sensor (not shown).

The user device 304 may be a system that the transducer package 302 is integrated with. While the user device 304 is illustrated as a single block, it should be appreciated that the transducer package 302 could be integrated with a system that includes many other function blocks or devices. For example, the user device 304 may be a telephone, tablet, computer, or the like. The user device 304 receives output signals 306 from the transducer package 302.

The output signals 306 include MEMS device output electrical signals from the transducer package 302. In some embodiments, the output signals 306 are analog signals. The output signals 306 may be, e.g., audio signals from a microphone. In some embodiments, the transducer package 302 may perform analog-to-digital conversion such that the output signals 306 are digital.

The sensor and control signals 308 are digital signals that include values from the environmental sensor packaged with the MEMS device on the transducer package 302. The sensor and control signals 308 are transmitted over a digital interface, such as Inter-Integrated Circuit ($I^2C$,) that also permits the user device 304 to configure the transducer package 302. In some embodiments, the output signals 306 and the sensor and control signals 308 may be separate output signals. In some embodiments, the signals may share a combined interface, such as SoundWire. Alternatively, other digital interface bus types such as $I^2S$ or Pulse Code Modulation (PCM) may be used.

The output signals 306 may be corrected by the transducer package 302 or the user device 304. Correction may be performed by identifying a property of the MEMS device in the transducer package 302 as a function of environmental conditions. For example, in some embodiments, sensitivity of a MEMS microphone may be identified as a function of temperature. Such a function may, for example, be expressed according to:

$$s_{mic}=k(1+a*(T-T_0)+b*(T-T_0)^2)$$

where T is the measured temperature, $T_0$ is a reference temperature, k is a constant relating voltage to pressure at the reference temperature, and a and b are polynomial coefficients. In some embodiments, k may be about 12 mV/Pa. The polynomial coefficients a and b may be stored in memory of the transducer package 302 or distributed to the user device 304 (discussed below). Once sensitivity of the MEMS microphone has been computed, a correction amount for the microphone may be computed according to:

$$o_{mic,corrected} = \frac{o_{mic} * k}{s_{mic}}$$

where $o_{mic,\ corrected}$ is the corrected output of the microphone, $o_{mic}$ is the output signal of the microphone, $s_{mic}$ is the computed sensitivity of the microphone (discussed above), and k is the constant relating voltage to pressure (discussed above). In some embodiments, $s_{mic}$ may be recomputed whenever a significant change in temperature occurs.

In some embodiments, the user device 304 performs correction of the output signals 306. In such embodiments, the user device 304 also receives the function that relates sensitivity of the MEMS device to environmental conditions. The function may be delivered to the user device 304 as, e.g., coefficients of the polynomial function. In some embodiments, the coefficients may be stored in memory within the transducer package 302 and included with the sensor and control signals 308 read by the user device 304. This memory may include, for example, non-volatile memory such as EEPROM, or may be implemented using fuses, electronic fuses (e-fuses), or one-time programmable (OTP) memory. In some embodiments, the memory comprises a metal mask. In some embodiments, the coefficients may be in the user device 304. For example, the coefficients may be supplied with an audio coder-decoder (codec) used by the user device 304. The coefficients may be supplied with a batch-type calibration, e.g., the user device 304 may select the coefficients in accordance with an identifier and/or version number encoded in the transducer package 302. The user device 304 corrects the output signals 306 by, e.g., adjusting the level of the signals. The level of the output signals 306 may be adjusted through an amplifier, or may be adjusted digitally.

In some embodiments, the transducer package 302 performs correction of the output signals 306. Such correction may be performed before the output signals 306 are output to the user device 304. In such embodiments, the coefficients are stored in memory in the transducer package 302 and correction computations are performed by a processor, microcontroller, or state machine included with the transducer package 302.

Figure 4:
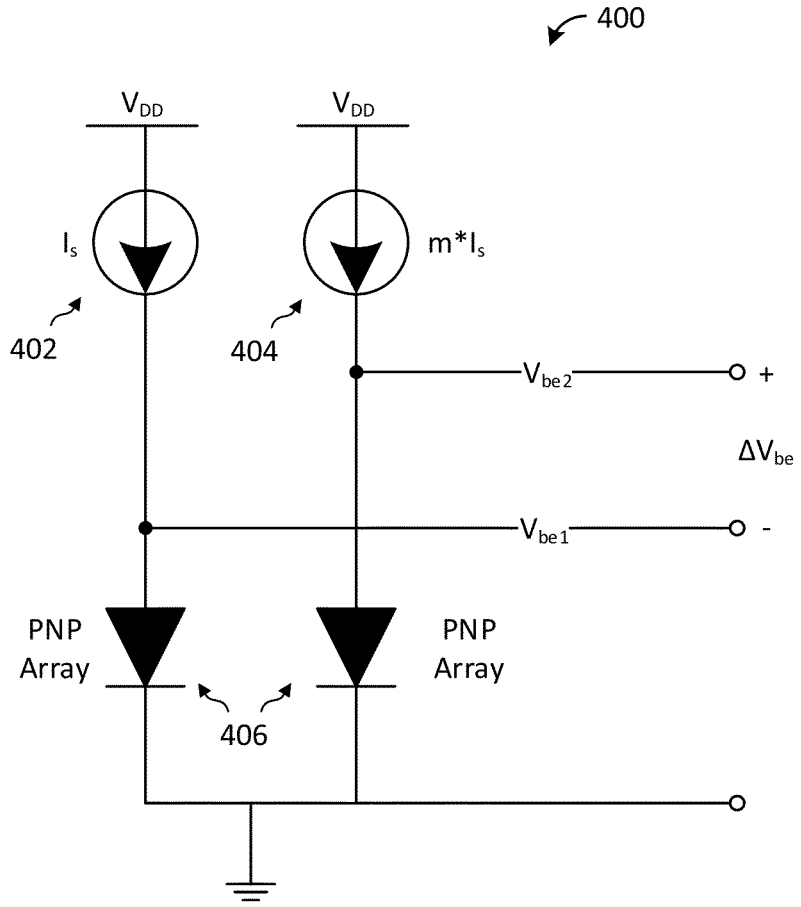
FIG. 4 illustrates a temperature sensor core.

FIG. 4 illustrates a temperature sensor core 400 that produces a voltage $\Delta V_{be}$ that is proportional to temperature. The temperature sensor core 400 includes a first current source 402, a second current source 404, and diodes 406. The diodes 406 may be implemented using diode-connected BJT transistors. In some embodiments, the diodes 406 may be implement using several PNP transistors. The first current source 402 and the second current source 404 are configured to have a fixed ratio m and are supplied to the diodes 406. The temperature sensor core 400 includes nodes $V_{be1}$ and $V_{be2}$ for measuring the change in difference voltage $\Delta V_{be}$ of the diodes 406. Temperature of the temperature sensor core 400 may thus be determined according to the relationship:

$$\Delta V_{be} = \frac{kT}{q} \cdot \ln(m),$$

where T is the temperature in kelvin, k is Boltzmann's constant, q is the charge on an electron, and m is the fixed ratio of the first current source 402 to the second current source 404. In some embodiments, the first current source 402 and the second current source 404 may produce the same current and the diodes 406 may be unequal sizes. In some embodiments, any suitable temperature sensor known in the art may be used.

Figure 5:
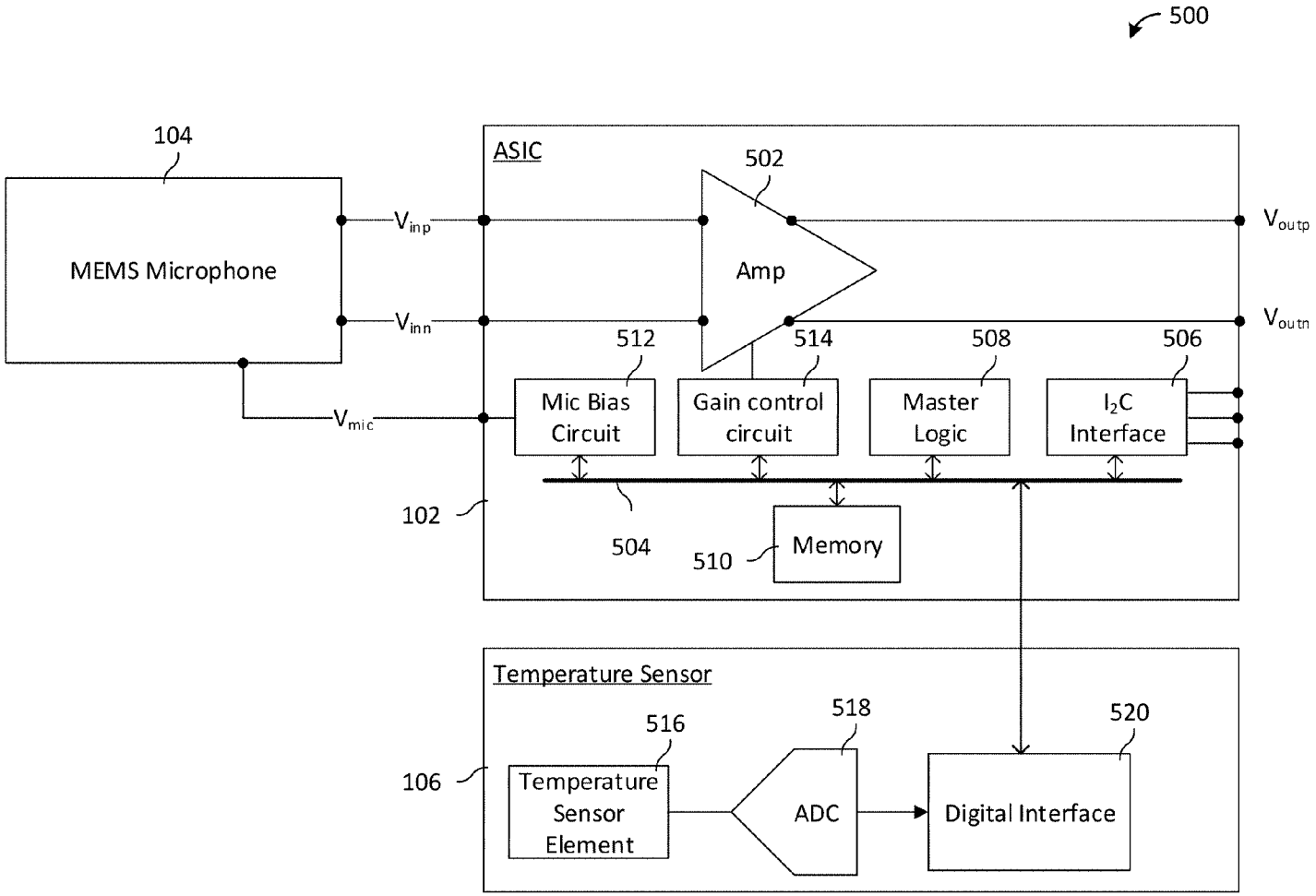
FIG. 5 illustrates a schematic diagram of an embodiment transducer system.

FIG. 5 illustrates a schematic diagram of an embodiment transducer system 500. The transducer system 500 includes the ASIC 102, the MEMS microphone 104, and the temperature sensor 106. In some embodiments, the transducer system 500 may be included in a single transducer package, such as that described above with respect to FIGS. 1-3, and may be implemented on several different microfabricated dies with circuit elements. In some embodiments, the temperature sensor 106 may be formed on a same microfabricated die as the ASIC 102 and/or the MEMS microphone 104.

The MEMS microphone 104 includes a bias voltage $V_{mic}$ and differential outputs $V_{inp}$ and $V_{inn}$, which are amplified by the ASIC 102. The MEMS microphone 104 has differential outputs in some embodiments, e.g., where the MEMS microphone 104 is a dual-backplate device. In some embodiments, the MEMS microphone may have a single backplate and may only have one output. The bias voltage $V_{mic}$ may be controlled by the ASIC 102 and the differential outputs $V_{inp}$ and $V_{inn}$ may be amplified by the ASIC 102 before being output to a system or application.

The ASIC 102 includes an amplifier 502, a bus 504, an $I^2C$ interface 506, a master logic unit 508, memory 510, a microphone bias circuit 512, and a gain control circuit 514. The amplifier 502 performs signal amplification of the outputs of the MEMS microphone 104, e.g., amplifies the differential outputs $V_{inp}$ and $V_{inn}$ to produce amplified outputs $V_{outp}$ and $V_{outn}$, respectively. In the illustrated embodiment, the amplifier 502 is a differential amplifier. In some embodiments, the amplifier 502 may be a dual amplifier that amplifies each respective differential output $V_{inp}$ and $V_{inn}$. In some embodiments, the amplifier 502 may combine the differential outputs $V_{inp}$ and $V_{inn}$ to produce a single amplified output. In some embodiments, the amplifier 502 includes a single input and duel outputs.

Devices in the ASIC 102 may (or may not) be interconnected on the bus 504. The $I^2C$ interface 506 is connected to the bus 504 and provides a digital interface for outside devices to interact with the transducer system 500. For example, the $I^2C$ interface 506 may output sensor data and/or calibration data to be read by a system that the transducer system 500 is integrated with, and may also receive control signals for the ASIC 102.

The master logic unit 508 is the main processing pipeline for the ASIC 102. It includes function units and/or circuitry for performing start-up sequences, controlling power modes, optimizing, testing, and debugging the ASIC 102. The master logic unit 508 may also include functions to calibrate the MEMS microphone 104 or other sensors that may be included with the transducer system 500. In some embodiments, the master logic unit 508 performs calculations used to correct the differential outputs $V_{inp}$ and $V_{inn}$. The master logic unit 508 may include a control state machine, which controls outputting of temperature values or calibration values on the $I^2C$ interface 506. In embodiments where signal correction is performed by the ASIC 102, the master logic unit 508 may evaluate a function relating sensitivity of the MEMS microphone 104 to values from the temperature sensor 106. The master logic unit 508 may then adjust the gain of the amplifier 502 according to the computed sensitivity of the MEMS microphone 104.

The memory 510 stores values used by the master logic unit 508 or external systems for calibration and/or correction of the output signal. Values in the memory 510 may be used by the master logic unit 508, or may be outputted on the $I^2C$ interface 506, to be read by a system or application that the transducer system 500 is integrated with. The memory 510 may be volatile memory, e.g., random access memory (RAM), or may be non-volatile memory, e.g., flash memory.

The microphone bias circuit 512 provides a bias voltage to the MEMS microphone 104. In some embodiments, the microphone bias circuit 512 may be connected to the bus 504 and controlled by the master logic unit 508. For example, in embodiments where the ASIC 102 performs signal correction, the master logic unit 508 may perform correction of the output signal by adjusting the sensitivity of the MEMS microphone 104. Such adjustment may be achieved by adjusting the bias voltages of the MEMS microphone 104. The microphone bias circuit 512 may include devices commonly used in the art for adjustment of electrical biasing, such as a charge pump.

The gain control circuit 514 controls the gain of the amplifier 502. The gain control circuit may be connected to the bus 504 and controlled by the master logic unit 508. For example, in embodiments where the ASIC 102 performs signal correction, the master logic unit 508 may perform correction of the output signal by adjusting the gain of the amplifier 502. The gain control circuit 514 may adjust gain by including, e.g., a programmable bias circuit, or a switched control used to select and deselect gain setting components in the amplifier 502, such as resistors, capacitors, or selectable gain stages.

The temperature sensor 106 includes a sensor element 516, an analog-to-digital converter (ADC) 518, and a digital interface 520. In some embodiments, the temperature sensor 106 may be connected to the bus 504 of the ASIC 102. In some embodiments, it may be connected to the ASIC 102 through other mechanisms, such as the $I^2C$ interface 506.

The sensor element 516 performs detection of changes in temperature. It may be a semiconductor device, such as the temperature sensor core 400 discussed above. In some embodiments, the transducer system 500 may be arranged such that the sensor element 516 is proximate the MEMS microphone 104. Such a configuration allows data collected from the temperature sensor 106 to be more accurately used to correct errors or changes in sensitivity in the output of the MEMS microphone 104. In some embodiments, the sensor element 516 may be part of the MEMS microphone 104. For example, in embodiments where the sensor element 516 is a resistive sensor, the diaphragm of the MEMS microphone 104 may be part of the sensor element 516. In some embodiments, there may be more than one sensor element 516; for example, there may be a sensor element integrated with the MEMS microphone 104, and another sensor element integrated with the ASIC 102. The output electrical signal from the sensor element 516 may be a voltage indicating the change in voltage $\Delta V_{be}$ of diodes 406 in the temperature sensor core 400.

The ADC 518 converts the electrical output signal from the sensor element 516 into data samples that are usable by the master logic unit 508. Data may be sampled by the ADC 518 continuously or may be sampled when requested by, e.g., the master logic unit 508.

The digital interface 520 receives data samples from the ADC 518, processes them, and makes them available to the master logic unit 508. Data samples from the ADC 518 may be digitally filtered by the digital interface 520 using, e.g., a low pass filter function. In some embodiments, the ADC 518 is a sigma-delta ($\Sigma\Delta$) module and the digital interface 520 includes a decimation filter for the ADC 518. This decimation filter may be implemented, for example, as a cascaded integrator-comb (CIC) filter. Alternatively, the ADC 518 may be implemented using other ADC architectures known in the art. The digital interface 520 may include memory for storing values or coefficients to be used by digital filters. Once data samples are captured and optionally filtered, they are made available to the master logic unit 508. The digital interface 520 may include output registers for latching the output temperature values from the temperature sensor 106 into the master logic unit 508.

Figure 6:
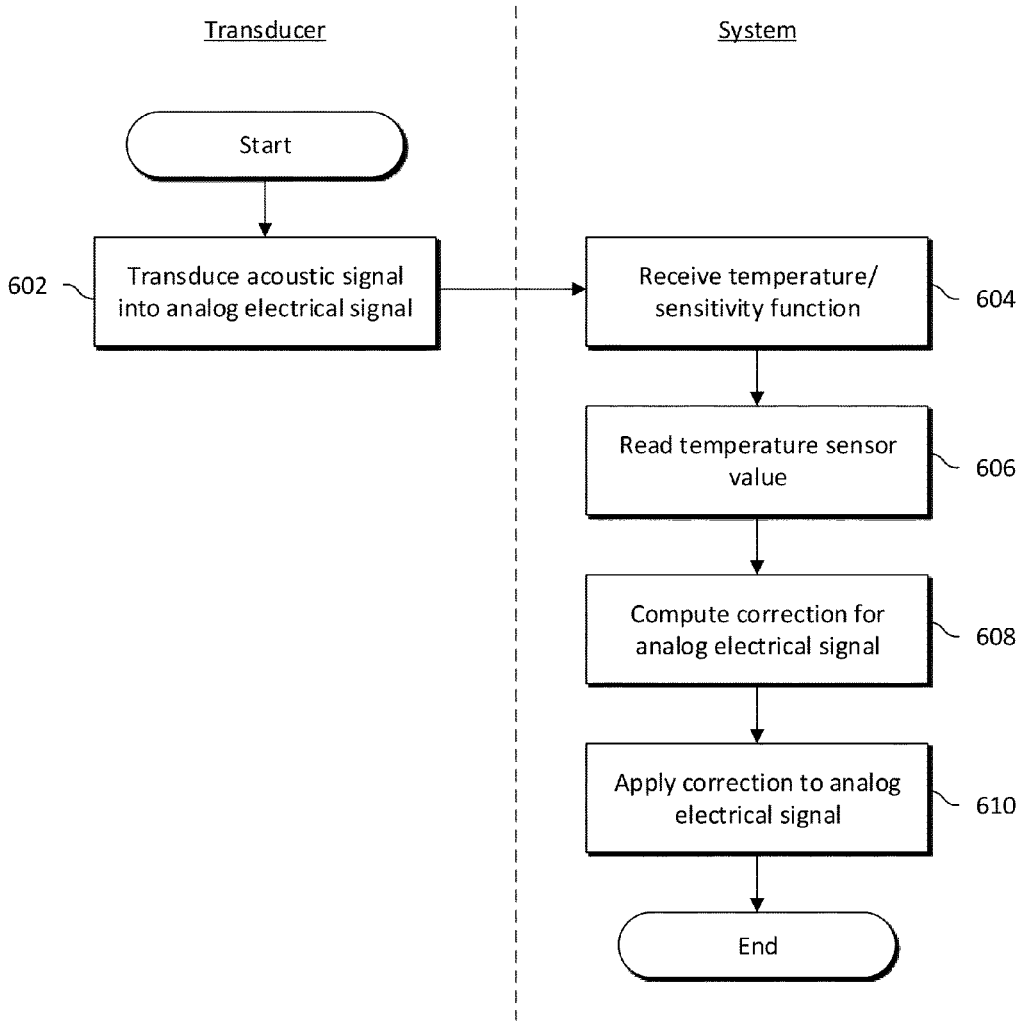
FIG. 6 illustrates an embodiment audio signal read method.

FIG. 6 illustrates an embodiment audio signal read method 600. The audio signal read method 600 may be indicative of operations occurring in a system with a sensor-supported microphone, such as the integrated system 300 illustrated in FIG. 3.

The audio signal read method 600 begins by transducing an acoustic signal into an analog electrical signal (step 602). Transducing of the acoustic signal may be performed by a MEMS microphone on a transducer package. Next, the system receives a function relating temperature and sensitivity of the MEMS microphone from the transducer package (step 604). The received function may comprise, e.g., coefficients of a polynomial. Next, the system reads values from the temperature sensor on the transducer package (step 606). Next, the system computes a correction for the analog electrical signal using the temperature sensor values and the function (step 608). Finally, the system applies the correction to the analog electrical signal (step 610). As illustrated in FIG. 6, some operations are performed by the transducer package while others are offloaded to the system. Performing correction of the analog electrical signal in the system allows for simplification of the transducer package.

Figure 7A:
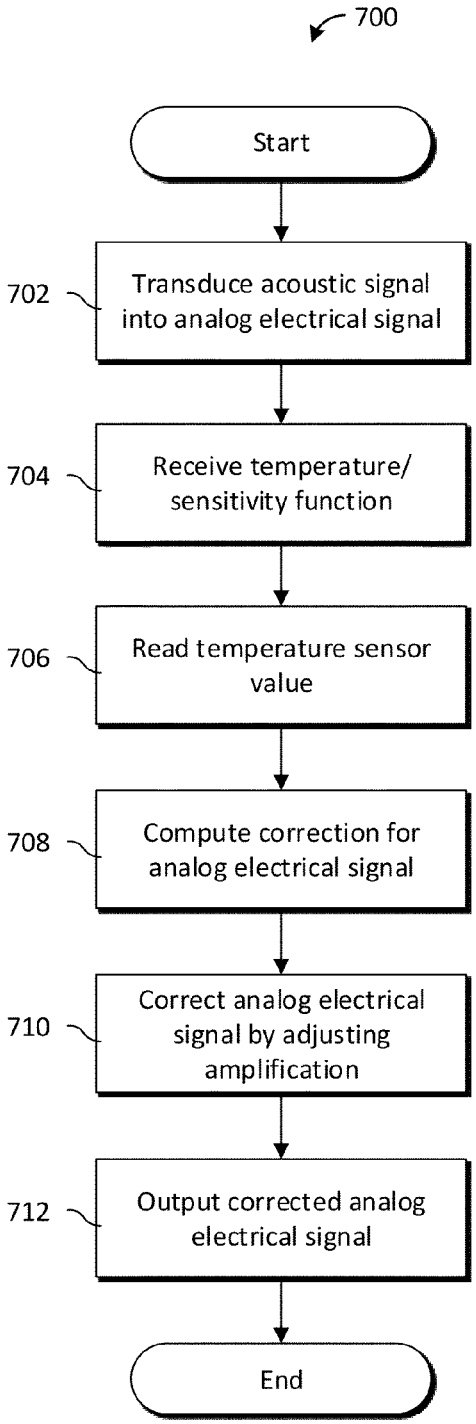
FIG. 7A illustrates an embodiment audio signal correction method.

FIG. 7A illustrates an embodiment audio signal correction method 700. The audio signal correction method 700 may be indicative of operations occurring in a transducer with a supporting sensor, such as the transducer system 500 illustrated in FIG. 5.

The audio signal correction method 700 begins by transducing an acoustic signal into an analog electrical signal (step 702). Next, a function relating temperature and sensitivity of the MEMS microphone is received (step 704). The received function may comprise, e.g., coefficients of a polynomial, and may be read from memory. Next, sensor values are read from the temperature sensor (step 706). Next, a correction for the analog electrical signal is computed using the temperature sensor values and the function (step 708). Next, the analog electrical signal is corrected by adjusting the amplification of the analog electrical signal (step 710). Adjustment of the amplification may be accomplished by, e.g., adjusting the bias voltage for the MEMS microphone or adjusting the gain of an amplifier that is amplifying the analog electrical signal. Finally, the corrected analog electrical signal is output to a system or application (step 712).

Figure 7B:
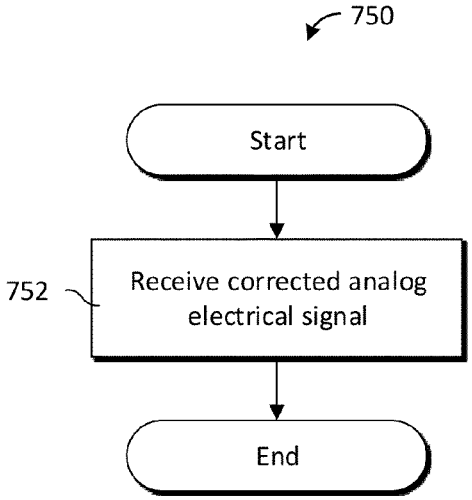
FIG. 7B illustrates an embodiment corrected audio signal read method.

FIG. 7B illustrates an embodiment corrected audio signal read method 750. The corrected audio signal read method 750 may be indicative of operations occurring in an application or system that includes a transducer package with a sensor-supported microphone, such as the user device 304 illustrated in FIG. 3.

The audio signal read method 750 begins by receiving a corrected analog electrical signal from a transducer package (step 752). The audio signal read method 750 thus concludes. As illustrated in FIGS. 7A and 7B, correction operations are performed by the transducer package while the system or application reads a corrected signal. Performing correction of the analog electrical signal in the transducer package allows for simplification of the system or application.

In accordance with an embodiment, a device is provided. The device includes an amplifier having an input configured to be coupled to a transducer, and an output coupled to an analog interface to output a transduced electrical signal from the transducer, a data bus configured to be coupled to an environmental sensor, a calibration parameter storage circuit coupled to the data bus, the calibration parameter storage circuit comprising calibration data relating sensitivity of the transducer with environmental measurements provided by the environmental sensor, and a digital interface coupled to the data bus and configured to output the calibration data and the environmental measurements.

In some embodiments, the device includes an amplifier gain control circuit coupled to the amplifier, and a master logic unit coupled to the data bus and the amplifier gain control circuit, the master logic unit configured to adjust gain of the amplifier based on the calibration data and the environmental measurements. In some embodiments, the device includes a user device coupled to the digital interface and the analog interface, the user device configured to adjust a level of the transduced electrical signal in response to the calibration data and the environmental measurements. In some embodiments, the device includes the environmental sensor. In some embodiments, the environmental sensor is a temperature sensor. In some embodiments, the environmental sensor is a mechanical stress sensor. In some embodiments, the environmental sensor is on a same semiconductor die as the amplifier and the calibration parameter storage circuit. In some embodiments, the device includes the transducer. In some embodiments, the transducer comprises a MEMS microphone. In some embodiments, the environmental measurements comprise temperature measurements, and in some embodiments the calibration data comprises coefficients of a polynomial function relating sensitivity of the MEMS microphone with the temperature measurements according to $s_{mic}=k\,(1+a*(T-T_0)+b*(T-T_0)^2)$, wherein k is a constant, a and b are the coefficients, T is one of the temperature measurements, and $T_0$ is an ideal temperature measurement. In some embodiments, the calibration data comprises coefficients of a polynomial function, the polynomial function relating sensitivity of the transducer with environmental measurements. In some embodiments, the calibration parameter storage circuit comprises memory.

In accordance with another embodiment, a system is provided. The system includes a package comprising an environmental port, a transducer disposed adjacent to the environmental port, an environmental sensor disposed proximate the transducer, and an application specific integrated circuit (ASIC), the ASIC including a calibration parameter storage circuit storing calibration data relating sensitivity of the transducer with environmental measurements provided by the environmental sensor.

In some embodiments, the environmental sensor comprises a temperature sensor. In some embodiments, the environmental sensor comprises a mechanical stress sensor. In some embodiments, the calibration data comprises coefficients of a polynomial function. In some embodiments, the polynomial function relates sensitivity of the transducer to the environmental measurements according to $s=k(1+a*(M-M_0)+b*(M-M_0)^2)$, wherein k is a constant, a and b are the coefficients, M is one of the environmental measurements, and $M_0$ is an ideal environmental measurement. In some embodiments, the system includes a user device, the user device configured to receive a transduced electrical signal, the calibration data, and the environmental measurements from the package. In some embodiments, the user device is further configured to adjust a level of the transduced electrical signal in response to the calibration data and the environmental measurements. In some embodiments, the package further includes an amplifier, and wherein the ASIC is configured to adjust a gain of the amplifier in response to the calibration data and the environmental measurements.

In accordance with yet another embodiment, a method is provided. The method includes receiving a function relating sensitivity of a transducer with ambient environmental conditions of the transducer, detecting ambient environmental conditions of the transducer, computing a drift in responsiveness of the transducer in accordance with the function and the detected ambient environmental conditions, and adjusting an output electrical signal from the transducer in accordance with the drift in responsiveness.

In some embodiments, adjusting the output electrical signal from the transducer comprises adjusting, by a user device, the output electrical signal. In some embodiments, adjusting the output electrical signal from the transducer comprises adjusting a gain of an amplifier coupled to the transducer, and amplifying, using the amplifier coupled to the transducer, the output electrical signal. In some embodiments, computing the drift in responsiveness of the transducer comprises evaluating the function with the detected ambient environmental conditions. In some embodiments, receiving the function comprises receiving coefficients of a polynomial relating sensitivity of the transducer with ambient environmental conditions of the transducer.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed:

1. A device comprising:

an amplifier having an input configured to be coupled to a transducer, and an output configured to be coupled to a user device, the amplifier configured to output a transduced electrical signal from the transducer to the user device as an analog signal;

a data bus configured to be coupled to an environmental sensor;

a calibration parameter storage circuit coupled to the data bus, the calibration parameter storage circuit comprising calibration data relating sensitivity of the transducer with environmental measurements provided by the environmental sensor; and a digital interface coupled to the data bus and configured to be coupled to the user device, the digital interface configured to output the calibration data and the environmental measurements to the user device as a digital signal.

2. The device of claim 1, further comprising:

an amplifier gain control circuit coupled to the amplifier; and a master logic unit coupled to the data bus and the amplifier gain control circuit, the master logic unit configured to adjust gain of the amplifier based on the calibration data and the environmental measurements.

3. The device of claim 1, further comprising the user device, wherein the user device is coupled to the digital interface and the output of the amplifier, the user device configured to adjust a level of the transduced electrical signal in response to the calibration data and the environmental measurements.

4. The device of claim 1, further comprising the environmental sensor.

5. The device of claim 4, wherein the environmental sensor is a temperature sensor.

6. The device of claim 4, wherein the environmental sensor is a mechanical stress sensor.

7. The device of claim 4, wherein the environmental sensor is on a same semiconductor die as the amplifier and the calibration parameter storage circuit.

8. The device of claim 1, further comprising the transducer.

9. The device of claim 8, wherein the transducer comprises a MEMS microphone.

10. The device of claim 9, wherein the environmental measurements comprise temperature measurements, and wherein the calibration data comprises coefficients of a polynomial function relating sensitivity of the MEMS microphone with the temperature measurements according to:

$$s_{mic}=k(1+a*(T-T_0)+b*(T-T_0)^2)$$

wherein k is a constant, a and b are the coefficients, T is one of the temperature measurements, and To is an ideal temperature measurement.

11. The device of claim 1, wherein the calibration data comprises coefficients of a polynomial function, the polynomial function relating sensitivity of the transducer with environmental measurements.

12. The device of claim 1, wherein the calibration parameter storage circuit comprises memory.

13. A system comprising:

a package comprising:

an environmental port;

a transducer disposed adjacent to the environmental port, the transducer having a first signal output;

an environmental sensor disposed proximate the transducer;

an application specific integrated circuit (ASIC), the ASIC including a calibration parameter storage circuit storing calibration data relating sensitivity of the transducer with environmental measurements provided by the environmental sensor; and a digital interface coupled to the ASIC and the environmental sensor, the digital interface having a second signal output; and a user device, the user device configured to receive a transduced electrical signal from the first signal output of the transducer, the user device further configured to receive the calibration data and the environmental measurements from the second signal output of the digital interface.

14. The system of claim 13, wherein the environmental sensor comprises a temperature sensor.

15. The system of claim 13, wherein the environmental sensor comprises a mechanical stress sensor.

16. The system of claim 13, wherein the calibration data comprises coefficients of a polynomial function.

17. The system of claim 16, wherein the polynomial function relates sensitivity of the transducer to the environmental measurements according to:

$$s=k(1+a*(M-M_0)+b*(M-M_0)^2)$$

wherein k is a constant, a and b are the coefficients, M is one of the environmental measurements, and $M_0$ is an ideal environmental measurement.

18. The system of claim 13, wherein the user device is further configured to adjust a level of the transduced electrical signal in response to the calibration data and the environmental measurements.

19. The system of claim 13, wherein the package further comprises an amplifier, and wherein the ASIC is configured to adjust a gain of the amplifier in response to the calibration data and the environmental measurements.

20. A method comprising:

receiving, by a user device, a function relating sensitivity of a transducer with ambient environmental conditions of the transducer, the function being included with a digital signal received over a digital interface;

receiving, by the user device, ambient environmental conditions of the transducer, the received ambient environmental conditions being included with the digital signal received over the digital interface;

computing, by the user device, a drift in responsiveness of the transducer in accordance with the function and the received ambient environmental conditions; and adjusting, by the user device, an output electrical signal from the transducer in accordance with the drift in responsiveness, the output electrical signal being an analog signal received from an amplifier, the transducer being coupled to an input of the amplifier, the user device being coupled to an output of the amplifier.

21. The method of claim 20, wherein adjusting the output electrical signal from the transducer comprises:

adjusting a gain of an amplifier coupled to the transducer; and amplifying, using the amplifier coupled to the transducer, the output electrical signal.

22. The method of claim 20, wherein computing the drift in responsiveness of the transducer comprises evaluating the function with the received ambient environmental conditions.

23. The method of claim 20, wherein receiving the function comprises receiving coefficients of a polynomial relating sensitivity of the transducer with ambient environmental conditions of the transducer.

* * * * *